United States Patent [19]

Ryan, Jr.

[11] 4,418,930

[45] Dec. 6, 1983

[54] BASEBALL/SOFTBALL CART

[76] Inventor: James J. Ryan, Jr., 8816 Rough Rider Rd. NE., Albuquerque, N. Mex. 87109

[21] Appl. No.: 288,190

[22] Filed: Jul. 31, 1981

[51] Int. Cl.[3] ..... B62B 1/10; B62B 1/26

[52] U.S. Cl. ..... 280/47.19; 280/47.26; 211/60 G; 211/15

[58] Field of Search ..... 280/47.24, 47.26, DIG. 6, 280/47.33, 47.18, 47.19, 43.1; 206/315 R, 315 B; 312/117, 119, 290, 306, 312, 330 R, 350; 211/60 R, 60 G, 60 T, 13, 14, 62, 64, 65, 14, 15

[56] References Cited

U.S. PATENT DOCUMENTS

| | | | |
|---|---|---|---|
| 1,290,290 | 1/1919 | Morio | 211/62 |
| 1,758,223 | 5/1930 | Fahr | 312/350 |
| 2,964,328 | 12/1960 | Muir | 280/47.19 |
| 3,591,194 | 7/1971 | Vega | 280/47.26 |
| 3,707,279 | 12/1972 | Kaiser | 280/47.26 |
| 3,869,137 | 3/1975 | Byron | 280/47.19 |
| 3,876,223 | 4/1975 | O'Reilly et al. | 280/47.19 |
| 4,017,091 | 4/1977 | Wallen | 280/30 |
| 4,057,309 | 11/1977 | Fragale | 312/290 |
| 4,227,710 | 10/1980 | Laub | 280/47.19 |

*Primary Examiner*—Joseph F. Peters, Jr.
*Assistant Examiner*—Timothy Roesch
*Attorney, Agent, or Firm*—Dennison, Meserole, Pollack & Scheiner

[57] ABSTRACT

A readily assemblable and disassemblable wheeled cart incorporating a first internal compartment having vertically aligned grids therein defining individual bat receiving cells, a second compartment divided into a pair of elongated pockets by dividers received in selected grooves in accordance with whether the pockets are to accommodate baseballs or softballs, and a cart-enclosing top hingedly mounted for outward swinging to a platform forming position. The pocket forming dividers include, in each instance, a laterally directed foot which underlies the pocket received balls for a vertical elevation of the balls upon a vertical shifting of the divider.

13 Claims, 8 Drawing Figures

BASEBALL/SOFTBALL CART

BACKGROUND OF THE INVENTION

The invention herein is particularly concerned with the provision of a wheeled cart adapted for the storage, transport and dispensing of baseball and/or softball bats and balls.

Conventionally, bats and balls are carried, rather haphazardly and awkardly, within flexible duffle bags and the like. At the site of the game, the equipment, if permanent racks are not available, will be laid out directly on the ground. The equipment will thus be exposed to adverse weather conditions, ground moisture, and the like. In addition, the equipment tends to get misplaced and is frequently underfoot.

A baseball equipment cart is presented in O'Reilly et al, U.S. Pat. No. 3,876,223, issued Apr. 8, 1975. The O'Reilly cart, while adapted to accommodate bats and balls, does so on cantilevered supports and in a horizontal shelf-like compartment with the major portion of the O'Reilly cart taken to accommodate equipment other than bats and balls.

Golf carts of a variety of different forms and constructions are also known, as exemplified by the following two U.S. patents:

No. 3,707,279 Kaiser Dec. 26, 1972
No. 4,017,091 Wallen Apr. 12, 1977

Carts with transporting wheels and internal partitions will also be noted in the following U.S. patents:

No. 2,964,328 Muir Feb. 20, 1959
No. 3,591,194 Vega July 6, 1971

SUMMARY OF THE INVENTION

The present invention proposes a wheeled cart, of a readily assemblable and disassemblable construction, specifically adapted for the accommodation of bats and balls utilized in the playing of baseball and/or softball. The cart provides a complete enclosure for the bats and balls, affording substantial protection during both the storage and transporting of the equipment. By the same token, the cart is provided with a hinged cover which, upon an outward swinging thereof, both provides a useable platform and allows free access to the bats and balls stored within defined areas within separately formed compartments.

The bats are mounted in parallel adjacent relation to each other, the balls stacking within a pair of pockets which also parallel the bats, thereby providing for a compact construction easily wheeled, carried, or stored, the overall height of the cart being only slightly greater than the length of the bats.

Also of significance is the ability of the cart to selectively accommodate baseballs or softballs, or, if so desired, both baseballs and softballs.

The cart is formed of multiple panels which, for ease of assembly and disassembly, are held together by screws, preferably engaged in preformed holes. When assembled, the cart includes a rectangular bottom panel, front and rear walls with opposed side walls extending therebetween, a hinged lid or top panel, and an internal partition dividing the interior of the cart into an enlarged bat receiving compartment and a relatively smaller ball receiving compartment. The bat compartment has the interior thereof divided into individual bat receiving spaces by means of pair of longitudinally spaced grids removably mounted on grid supports secured to the inner faces of the walls and partition which define the bat compartment.

The ball compartment is divided into two ball pockets and a central miscellaneous storage section by means of two longitudinally slidable dividers or divider panels. Two sets of grooves are provided for each divider whereby the width of the pocket formed thereby can be adjusted to accommodate either baseballs or the larger softballs. An appropriate spacer will also be provided for selectively positioning within each pocket to conform the interior thereof to baseballs.

The cart enclosing top lid will be hinge mounted to pivot from a closed position to an outwardly swung horizontal position paralleling the top of the cart and defining a support platform for use as a scorekeeper's table, a shelf for temporarily holding additional equipment, and the like.

In order to dispense the balls from the elongated pockets, each of the dividers includes a laterally directed foot which underlies the adjacent ball stack whereby the balls will be elevated for selective removal thereof upon an upward sliding of the divider. The divider in turn will be provided with appropriate grip means.

Additional objects and advantages of the invention will become apparent from the details of construction and manner of use as more fully hereinafter described and claimed.

DESCRIPTION OF THE PREFERRED EMBODIMENT

Figure 1:
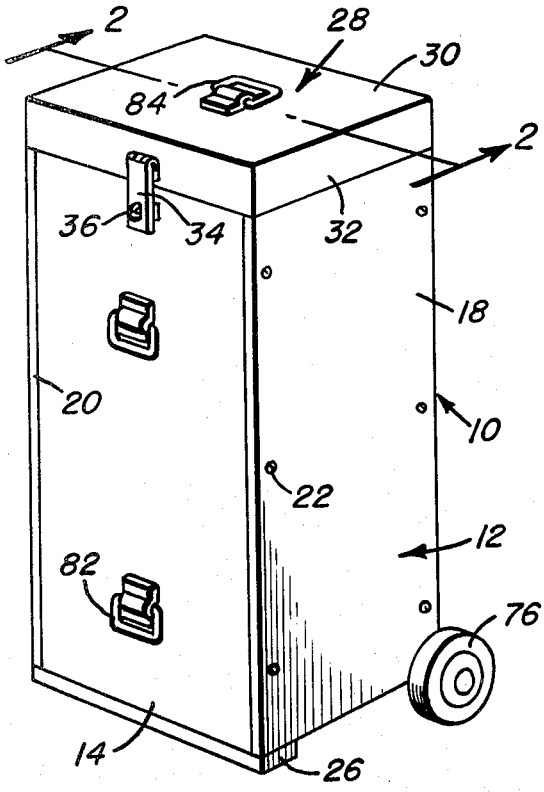
FIG. 1 is a front perspective view of the bat and ball cart comprising the present invention.

Referring now more specifically to the drawings, the combined bat and ball cart is generally designated by reference numeral 10. The cart 10 basically comprises a vertically elongated rectangular housing 12 defined by front and rear walls 14 and 16 interconnected by opposed side walls 18 and 20. As will be appreciated from FIGS. 1 and 4 in particular, the side walls 18 and 20 have the opposed vertical edge portions thereof overlapping the vertical edges of the front and rear panels for securement thereto, preferably by screws, 22, selected ones of which have been illustrated.

The lower end of the housing 12 is closed by a bottom panel 24 which is received therein and retained by screws driven through the lower edge portions of the walls and into the periphery of the bottom panel. In order to further rigidify the construction and provide additional support for the bottom panel 24, a pair of transversely extending support strips or skids 26 can be provided in underlying relation to the bottom panel and the lower edges of the front and rear walls respectively.

Figure 6:
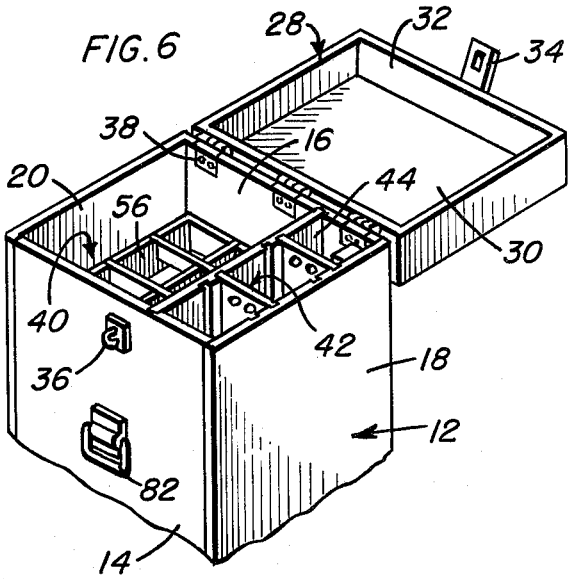
FIG. 6 is a perspective view of the upper portion of the cart with the cover in its open platform-forming position.

Access to the interior of the housing 12 is to be provided through the open upper end thereof. This open upper end is selectively closed by a cover or lid 28 including a flat top 30 with a depending rectangular peripheral flange 32. The peripheral flange 32 is of equal size with the upper end of the housing 12 and, in the closed position of the cover, seats directly on the periphery defined by the upper edges of the housing walls. A depending hasp 34 fixed to the front portion of the cover flange 32 selectively engages over a staple 36 affixed to the upper portion of the front wall 14 for a retention and/or locking of the cover as desired. The cover 28 is hingedly mounted to the rear wall 16, as will be best noted in FIG. 6, by appropriate angle hinges 38 which allow for an upward and rearward swinging of the cover 28 to a position wherein the rear portion of the cover flange 32 abutts against the outer surface of the rear wall 16 with the planar top 30 of the cover 28 horizontally positioned so as to provide a support platform for use as a scoring table, the storage of additional equipment, or the like.

The housing is divided into two full height compartments, a bat compartment 40 and a ball compartment 42, by a full height vertical partition 44 positioned transversely between the front and rear walls 14 and 16. For ease of assembly, the partition 44 can be received within opposed grooves 46 defined in the inner faces or surfaces of the front and rear panels 14 and 16.

The bat compartment 40 is divided into a plurality of laterally aligned vertical cells, each capable of receiving a single bat 48 and segregating the bat, for easy access thereto and protection thereof, from the adjacent bats. These cells are formed by at least two vertically spaced grids 50 defined by crossed and interlocked slats 52, each terminating in a free outer end portion adapted to nest within an appropriate upwardly directed slot 54 provided within a support strip 56. Each grid 50 is supported by four support strips 56 respectively affixed to the inner surface of the side wall 20, the opposed surface of the partition or partition wall 44 directed inward to the bat compartment 40, and the inner surfaces of those portions of the front and rear walls 14 and 16 which define the bat compartment. As will be noted from FIG. 2 in particular, the grids 50 are spaced vertically from each other and from both the upper and lower ends of the housing or bat compartment. Further, in order to define the individual bat receiving cells, it will be recognized that the grids are in vertical alignment with each other, providing in effect for the peripheral confinement of each bat 48 toward both the upper and lower ends thereof. While the illustrated grids define nine bat cells aligned in three rows of three, it will be appreciated that, depending upon the size of the bat compartment, grids defining a lesser or greater number of cells can be utilized.

Referring now to the ball compartment 42, this compartment is divided into front and rear full height vertical ball pockets 58 by full height vertical dividers or divider panels 60, each received within one of two pairs of vertical guide slots 62 and 64 provided in the opposed faces of the end wall 18 and partition 44 which define the bat compartment. As will be best noted from FIG. 4, the divider 60 forming the front ball pocket 58 is received within the pair of grooves 64 furtherest from the adjoining front wall 14 to define a maximum area pocket. When so positioned, the pocket 58 is specifically adapted for the accommodation of the larger softballs. A positioning of the divider 16 in the pair of grooves 62 which are more closely positioned to the adjacent wall, as is the case with the rear pocket 58 of FIG. 4, results in a sizing of the pocket for the accommodation of the smaller baseballs. It is particularly desired that the pockets 58 be specifically sized for the balls to be received therein in that this avoids any tendency for the balls to jam, not withstanding the extended vertical stacking thereof, particularly during the dispensing of the balls as shall be described presently.

Figure 2:
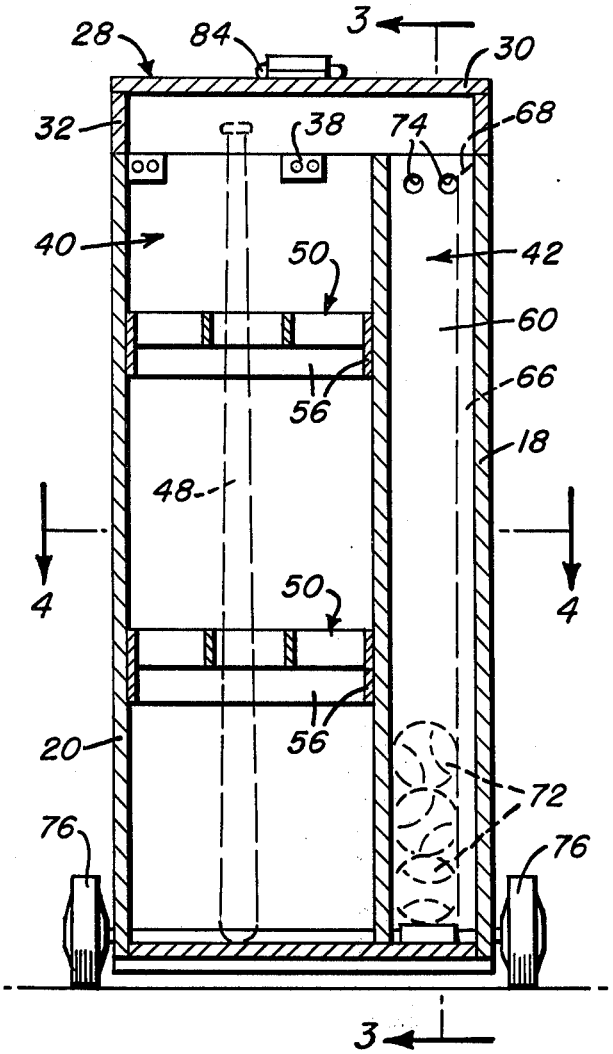
FIG. 2 is an enlarged vertical cross-section taken substantially on a plane passing along line 2—2 in FIG. 1.
Figure 4:
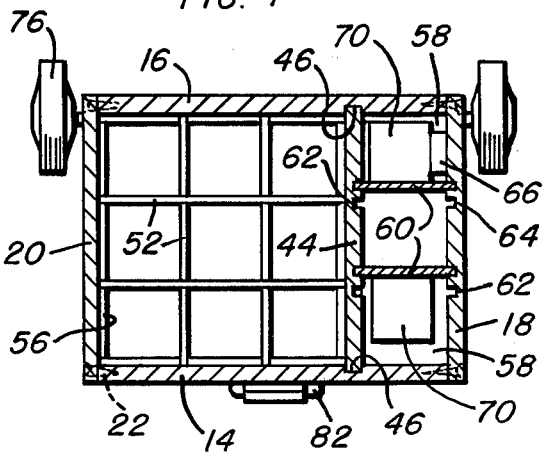
FIG. 4 is a transverse cross-sectional view taken substantially on a plane passing along line 4—4 in FIG. 2.
Figure 8:
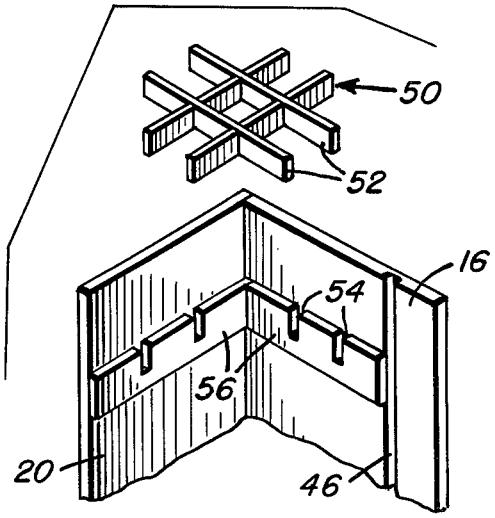
FIG. 8 is a perspective detail illustrating the grid construction within the bat compartment.

Noting FIGS. 2 and 4, when the divider 60 is positioned so as to provide for the smaller area pocket for the accommodation of baseballs, the lateral width of the pocket is correspondingly also reduced by a full height vertical spacer or spacer strip 66 affixed to and along the inner surface of the side wall 18. The upper edge 68 of this spacer 66 may be slightly downwardly and inwardly inclined so as to facilitate an introduction of the baseballs.

The dispensing of the balls from the ball pockets 58 is effected by means of a laterally directed foot 70 affixed rigidly to the lower end portion of each of the dividers 60 and directed into the corresponding pocket 58 in underlying relation to the lowermost ball of the stack of balls which, incidently, have been generally suggested at 72 in FIG. 2.

The actual dispensing of the balls 72 from either pocket 58 is effected by a grasping of the upper end of the corresponding divider or divider panel 60, this being facilitated by a pair of finger holes 74 formed at the upper end thereof, and vertically raising the divider with the lower foot 70 upwardly moving the stack of balls for a selective manual withdrawal of the balls from the upper end of the housing. As will be appreciated, by sizing the pockets so as to retain the balls in an essentially straight stack, there is no tendency for the stack of balls to jam during the withdrawal thereof. It is for this reason in particular that the size of the pockets is adjustable by a selective positioning of the dividers 60, whereby the cart can be used alternatively for baseball equipment or softball equipment. Similarly, and in fact as illustrated, by the provision of one small pocket and one large pocket, both baseball and softball equipment can be simultaneously accommodated.

Wheeled mobility for the housing 12 is provided for by a pair of wheels 76 positioned outward of the opposed side walls 18 and 20 and mounted on the opposed ends of a wheel axle 78 rotatably received through the lower rear corners of the side walls 18 and 20, immediately above the bottom panel 24 and immediately inward of the rear panel 16.

Figure 7:
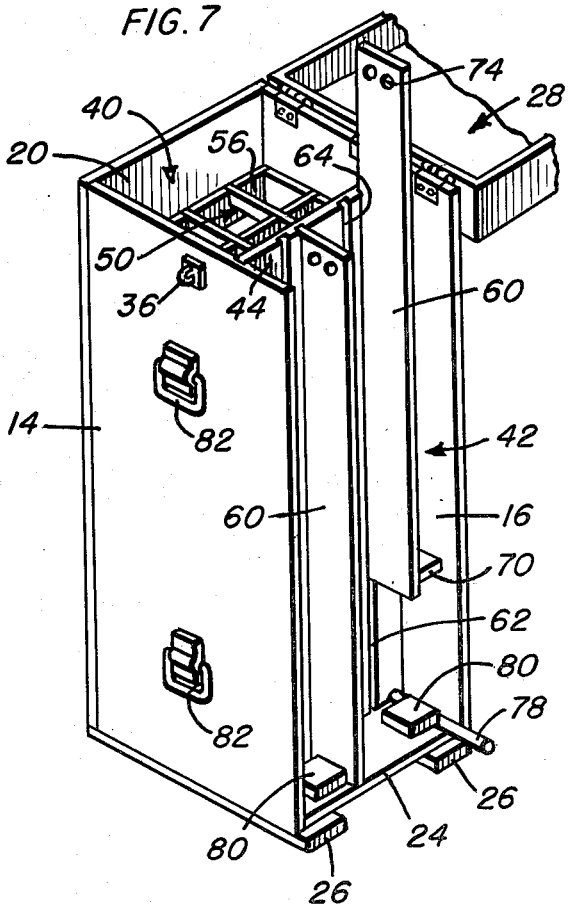
FIG. 7 is a perspective detail of the cart with the near side wall removed and the various components exposed for purposes of illustration.
Figure 5:
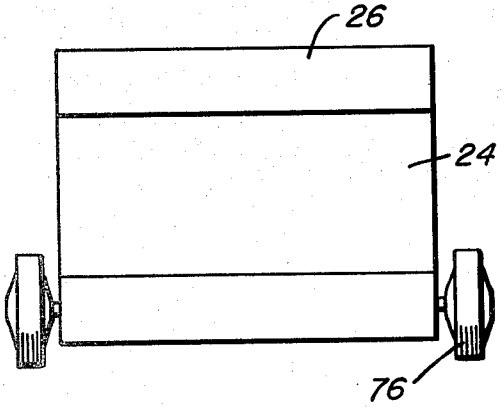
FIG. 5 is a bottom plan view.
Figure 3:
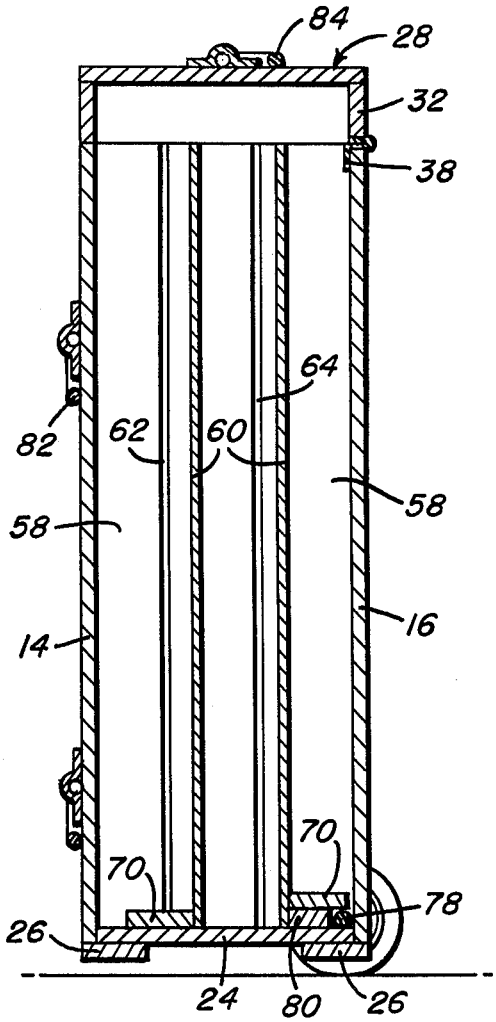
FIG. 3 is a vertical cross-sectional view taken substantially on a plane passing along line 3—3 in FIG. 2.

Noting FIGS. 3 and 7 in particular, in order to avoid any interference of the axle 78 with the stack of balls within the rear ball pocket 58, through which the axle 78 extends, a small spacer block 80 is affixed to the upper surface of the bottom panel 24 within this rear pocket 58, defining in effect a small rear compartment in which the axle passes. The provision of this spacer block 80 of course requires that the associated ball retrieving foot 70 be affixed to the corresponding divider 60 at a point slightly above the lower end thereof whereby the foot rests on the block 80 rather than directly on the upper surface of the bottom panel 24.

As a further means for assisting in the manipulation, carrying or positioning of the cart 10, a pair of appropriate hand grips or handles 82 can be affixed at spaced points to the front wall 14. A similar handle 84 will also normally be provided on the cover or lid 28.

From the foregoing, it will be appreciated that a unique combined bat and ball cart has been defined. The cart, in addition to providing for the accommodation of both bats and balls, is convertible in the sense that the cart can be adapted to selectively accommodate either baseball equipment or softball equipment or, if so desired, a combination of both. The entire assembly is wheel mounted for a simplified transporting of the equipment. In addition, the wheels are so positioned relative to the base of the equipment confining housing as to enable a substantially vertical positioning of the housing, thus providing a convenient storage rack for use during actual games.

The entire structure is specifically formed for ready assembly and disassembly, utilizing, basically, only screws in the assembly of the basic structural components with the interior partitions, dividers, and the like being received within slots, grooves, and the like. As such, the cart can be readily disassembled and compacted for shipping, storage or the like, and subsequently assembled as required.

I claim:

1. A bat and ball cart comprising peripheral walls defining a vertically elongated housing with an interior, said housing having upper and lower ends, a bottom panel closing said lower end, a vertical partition transversely spanning the interior of the housing and defining two vertical compartments therein, each accessible through the upper end of the housing, said compartments comprising a bat compartment and a ball compartment, means dividing the interior of said bat compartment into a plurality of laterally aligned vertical cells, each cell adapted to vertically receive a bat and individually confining the bat, said ball compartment being adapted to receive balls therein for the full vertical height of the housing,, and ball discharge means for vertically elevating balls within the ball compartment to the upper end of the housing for removal therefrom, said ball discharge means being located within said ball compartment and vertically moveable relative thereto, said ball compartment including at least one vertical pocket defined therein for receiving a vertical stack of balls, and means for selectively varying the width of said pocket for the selective accommodation of baseballs or softballs.

2. The cart of claim 1 including a vertical divider positioned transversely across said ball compartment to define, laterally to one side thereof, said vertical ball receiving pocket.

3. The cart of claim 2 wherein said means for selectively varying the width of said pocket comprises laterally spaced first and second mounting means in said ball compartment, said first and second mounting means selectively receiving said divider.

4. The cart of claim 3 wherein said divider includes a lower end portion having a laterally directed foot member thereon adapted for positioning beneath a stack of balls, said divider being vertically slidable to selectively raise the foot member and any balls positioned thereon, said foot member comprising said ball discharge means.

5. The cart of claim 4 wherein said first and second mounting means each comprise a pair of laterally aligned vertical slots, one in said vertical partition and one in an opposed wall of said peripheral walls.

6. The cart of claim 5 including a second vertical divider positioned transversely across said ball compartment defining a second ball-receiving vertical pocket, means for selectively varying the position of the second divider to vary the width of the second pocket.

7. The cart of claim 5 wherein the means dividing the bat compartment into a plurality of cells comprises at least one grid defined by crossed slats.

8. The cart of claim 7 wherein a second cell defining grid is provided within said bat compartment in vertically spaced relation to said one grid.

9. The cart of claim 8 including a cover for the upper end of said housing, and means mounting said cover for selective movement between a first position closing the upper end of the housing and a second position projecting horizontally outward from the upper end of the housing.

10. The cart of claim 9 including wheel means mounted on the lower end of said housing for support and wheeled movement of said housing.

11. The cart of claim 7 wherein said first and second mounting means each comprise a pair of laterally aligned vertical slots, one in said vertical partition and one in an opposed wall of said peripheral walls.

12. The cart of claim 1 including a second vertical pocket defined within said ball compartment and means for selectively varying the width of said second pocket for the selective accommodation for baseballs or softballs.

13. A bat and ball cart comprising peripheral walls defining a vertically elongated housing with an interior, said housing having upper and lower ends, a bottom panel closing said lower end, a vertical partition transversely spanning the interior of the housing and defining two vertical compartments therein, each accessible through the upper end of the housing, said compartments comprising a bat compartment and a ball compartment, means dividing the interior of said bat compartment into a plurality of laterally aligned vertical cells, each cell adapted to vertically receive a bat and individually confining the bat, said ball compartment being adapted to receive balls therein for the full vertical height of the housing, and ball discharge means for vertically elevating balls within the ball compartment to the upper end of the housing for removal therefrom, said ball discharge means being located within said ball compartment and vertically moveable relative thereto, said ball compartment including at least one vertical pocket defined therein for receiving a vertical stack of balls, and a vertical divider positioned transversely across said ball compartment to define, laterally to one side thereof, said vertical ball receiving pocket, said divider including a lower end portion having a laterally directed foot member thereon adapted for positioning beneath a stack of balls, said divider being vertically slidable to selectively raise the foot member and any balls positioned thereon, said foot member comprising said ball discharge means.

* * * * *